United States Patent [19]

Pommenville

[11] Patent Number: 4,830,248

[45] Date of Patent: May 16, 1989

[54] ACCESSORY HOLDER FOR GOLF BAG

[76] Inventor: Robert A. Pommenville, 42 Robin Hood Dr., Seekonk, Mass. 02771

[21] Appl. No.: 185,411

[22] Filed: Apr. 25, 1988

[51] Int. Cl.[4] ..... A45F 5/00

[52] U.S. Cl. ..... 224/269; 224/918; 224/247

[58] Field of Search ..... 224/191, 269, 918, 274, 224/277, 904; 40/642, 658; 24/3 R, 3 E, 3 H, 3 L, 3 M, 10 R; 206/315.2, 315.3, 315.5; 273/32 R, 32 B, DIG. 26; 281/15 B; 248/100; D10/46.1

[56] References Cited

U.S. PATENT DOCUMENTS

| | | | |
|---|---|---|---|
| 2,589,126 | 3/1952 | Payne | 224/247 |
| 2,682,981 | 7/1954 | Previdi | 224/918 |
| 2,802,250 | 8/1957 | Klotz | 224/918 |
| 3,830,415 | 8/1974 | Jacobson | 224/918 |
| 4,157,152 | 6/1979 | Blastic | 224/274 |
| 4,449,310 | 5/1984 | Kline | 224/918 |
| 4,475,676 | 10/1984 | Smith | 224/247 |

*Primary Examiner*—Henry J. Recla
*Assistant Examiner*—Glenn T. Barrett
*Attorney, Agent, or Firm*—Salter & Michaelson

[57] ABSTRACT

A device for attachment to a golf bag and for holding golf accessory articles, such as a score card, pencil, golf tees and the like, including a first clip member having opposed legs integrally joined at an end thereof, one of the legs defining a spring element for frictionally mounting the first clip member over an edge of the golf bag, wherein the legs of the first clip member engage inner and outer surfaces of the golf bag to securely mount the device in place thereon. A second clip member is integrally joined to the first clip member and includes an inner leg that is connected to a leg of the first clip member and is disposed in substantially face-to-face relation therewith but is pivotal relative thereto for accommodating a score card in removable relation between. The second clip member includes another leg that is integrally joined to the inner leg of the second clip member by an upper curved portion, the last named leg of the second clip member having an outer portion that normally is urged into engaging relation with the adjacent surface of the inner leg of the second clip member, openings being formed in the upper curved portion that joins the legs of the second clip member for receiving other accessory articles therein, such as a pencil and golf tee.

5 Claims, 1 Drawing Sheet

ACCESSORY HOLDER FOR GOLF BAG

BACKGROUND OF THE INVENTION

The present invention relates to an accessory holder for a golf bag and more particularly includes a device for attachment to a golf bag for holding golf accessory articles, such as a score card, pencil, golf tees and the like.

In playing golf, accessories such as the score card, pencil and tees, in the absence of the use of a motorized cart, are normally carried by the golfer on the person and usually in his pocket. Such use is not always desirable because the points of the pencil and golf tees make the carrying of these accessories in the user's pockets awkward and difficult to remove from the user's pocket when needed. Further, the score card as carried by the user, unless folded to a more compact condition, cannot be carried in the user's pocket; and when the score card is folded, entering the scores on the folded lines sometimes obscures the numeral as entered. In those circumstances, when the user either carries his own bag or pulls a hand cart, it is more desirable to carry the accessory articles on the bag itself so that they are always readily available for use.

Prior to the instant invention, some efforts have been made to attach accessory holders to golf bags or on the body of the person; and examples of this type of accessory holder are illustrated in the PREVIDI, U.S. Pat. No. 2,682,981; KLOTZ, U.S. Pat. No.2,802,250; JACOBSON et al, U.S. Pat. No. 3,830,415; and KLINE, U.S. Pat. No. 4,449,310. The devices as illustrated in these aforesaid patents, which represent the best prior art known to applicant relative to the subject invention, fail to provide a device that is practical for the purpose intended, as will be set forth hereinafter.

The patent to KLINE, U.S. Pat. No. 4,449,310, which is the closest prior art of which applicant aware, is somewhat similar to applicant's accessory holder but does not provide as convenient access to the pencil and tees as mounted on the holder. Further, the KLINE golf clip as illustrated is deficient in the manner in which the clip is mounted on the upper edge of a golf bag and is easily dislodged therefrom, when, for example, the user carries his bag and places the bag on the ground prior to a shot to be taken. The other patents referred to above which show accessory holders are also deficient in the manner of use thereof; and although the patent to KLOTZ, U.S. Pat. No. 2,802,250, does show an implement holder as mounted on the upper edge of a golf bag, the holder is not effective for retaining a score card in position nor in mounting the holder in secure position on the upper edge of the golf bag. The remaining patents show holders that are mounted on the person and only serve to hinder the swing of the golfer and are defective for this reason.

As will be described hereinafter, applicant has developed a unique accessory holder for mounting on a golf bag that provides for secure attachment of the holder to the golf bag and also insures that the accessory articles are securely retained thereon for removal as required.

SUMMARY OF THE INVENTION

The device as provided by the subject invention is conveniently attachable to a golf bag and retains golf accessory articles, such as a score card, pencil, golf tees and the like, in secure but easily removable position for convenient access to the user. The device comprises a first clip member having adjacent opposed legs that are integrally joined at an end thereof by a curved portion of predetermined radius. One of the legs has a free end that is normally urged toward the adjacent leg in engaging relation therewith and defines a spring element. The first clip member is insertable over an edge of the golf bag, wherein the one leg is urged into firm engaging relation with an interior surface of the golf bag, and the adjacent leg firmly engages an outer surface of the golf bag, wherein the device is securely mounted in place on the bag. A second clip member is integrally joined to the first clip member and includes an inner leg that is joined to the second leg of the first clip member by a bent end of reduced radius relative to the radius of the curved portion, wherein the joined legs of the clip members are normally disposed in face-to-face relation but are pivotally movable relative to each other. A score card is conveniently and removably retained between the joined legs when the device is mounted in place on the golf bag. An outer leg is integrally joined to the inner leg of the second clip member by a second curved portion that has a radius of curvature similar to the radius of curvature of the first named curved portion, the outer leg of the second clip member normally extending at an angle relative to the inner leg thereof, wherein the end of the outer leg that is opposite to the second name curved portion is urged into engagement with an adjacent portion of the inner leg, and at least on opening being formed in the second named curved portion for receiving a pencil therein. The portion of the pencil that extends through the opening engages the adjacent surfaces of the inner and outer legs of the second clip member in frictional contact therewith, and is thereby retained in removable position in the opening for easy access to the portion thereof that is located above the opening, whereby the pencil is removed as required for use. In the form of the invention as disclosed, additional openings are also formed in the second named curved portion for inserting golf tees therein, both the pencil and golf tees having exposed portions facing upwardly that provide for easy and simple access thereto by the user when they are to be removed from their stored positions for use.

Accordingly, it is an object of the present invention to provide a device for simple and secure attachment to a golf bag for holding golf accessory articles and that includes integrally joined clip members that not only provide for the firm attachment of the device to the golf bag but also are constructed and arranged for retaining accessory articles, such as a score card, pencil, golf tees and the like, in a convenient position for easy removal and use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 2:
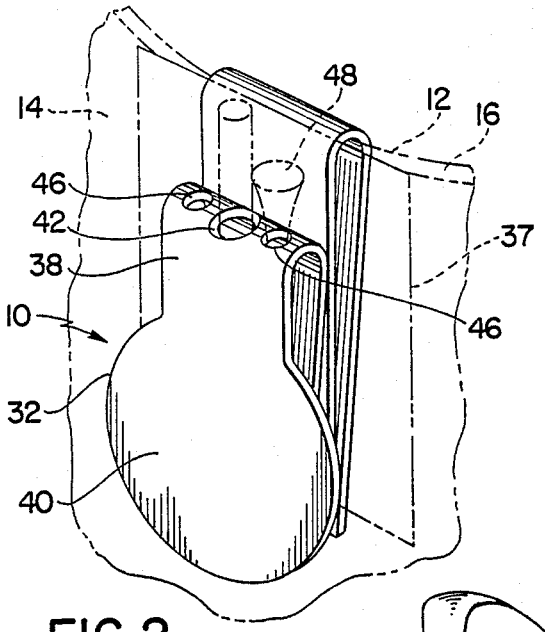
FIG. 2 is a perspective view of the device of the subject invention as mounted on the upper edge of a golf bag, which is shown in phantom.
Figure 1:
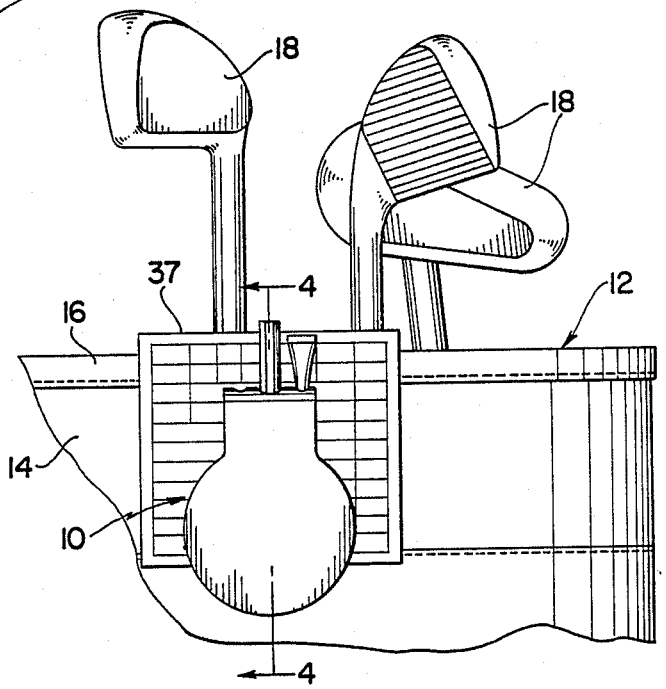
FIG. 1 is a fragmentary elevational view of an upper portion of a golf bag with golf clubs located therein and showing the device of the subject invention as mounted on the upper edge of the golf bag.

Referring now to the drawing and particularly to FIGS. 1 and 2, the device as embodied in the subject invention is illustrated and is generally indicated at 10. The device 10 is preferably usable with a golf bag, an upper portion of which is illustrated in FIGS. 1 and 2, and is generally indicated at 12. The golf bag 12 includes a body 14 that terminates at the upper end in a beaded edge 16. Normally locate in the golf bag 12 as illustrated in FIG. 1 are conventional golf clubs 18.

Figure 3:
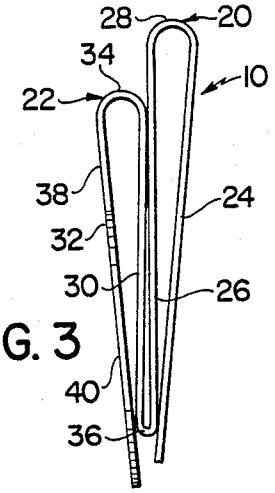
FIG. 3 is a side elevational view of the device.
Figure 4:
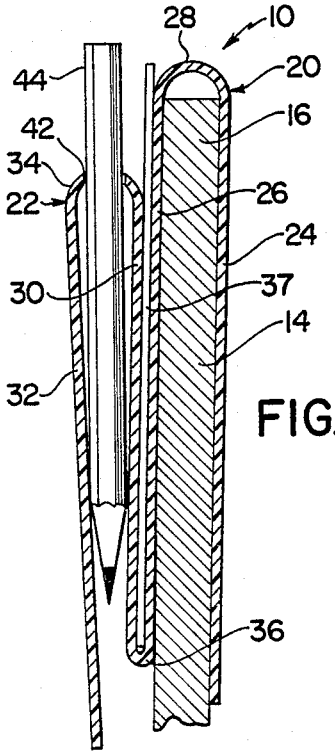
FIG. 4 is a sectional view taken along lines 4—4 in FIG. 1.

Referring now to FIGS. 2, 3 and 4, the device 10 is illustrated in detail and includes a first clip member generally indicated at 20 to which a second clip member generally indicated at 22 is integrally joined. The device 10 as defined y the clip members 20 and 22 is preferably formed of any suitable plastic material that is bendable to a desired configuration. In this connection, the clip members 20 and 22 of the device 10 are formed in a one-piece construction from a single piece of plastic material that has been bent to the configuration as shown.

Formed as part of the clip member 20 is a first leg 24 that is interconnected to a second leg 26 and spaced therefrom by an upper curved portion 28. The upper curved portion 28 is formed with a predetermined radius of curvature that enables the clip member 20 to be securely mounted over the beaded edge 16 of the golf bag 12. As shown more clearly in FIG. 3, the first leg 24 is normally inclined relative to the second leg 26, the lowermost portion of the first leg 24 engaging the lowermost portion of the second leg 26 and being urged to the engaging position by the spring tension exerted thereon through the upper curved portion 28. Thus, the first leg 24 is yieldably movable relative to the second leg 26 when the clip portion 20 is mounted over the beaded edge 12 wherein the first leg 24 exerts frictional pressure on the interior surface of the golf bag with which it engages as mounted thereon. As shown in FIG. 4, the interior surface of the second leg 26 firmly engages the exterior surface of the body 14 of the golf bag and cooperates with the first leg 24 to locate the device in firm position on the uppermost portion of the body 14 of the golf bag.

The second clip member 22 is defined by an inner leg 30 that is interconnected to an outer leg 32 through an upper curved portion 34, the radius of curvature of which is substantially the same as that of the upper curved portion 28. As will be hereinafter described, the radius of curvatuure of the upper curved portion 34 provides a sufficient surface area for the location of openings therein, the purpose of which will also be set forth hereinafter. As shown in FIGS. 3 and 4, the inner leg 30 is integrally joined to the second leg 26 of the first clip member 20 through a lower bent portion 36 that has a radius of curvature that is dimensioned to locate the inner leg 30 in substantially engaging relation with respect to the second leg 26. The outer leg 32 is also angled relative to the inner leg 30 and is normally urged into engaging relation therewith at the bottommost ends thereof by the spring action as exerted by the upper curved portion 34. Thus, as shown in FIG. 3, both the first leg 24 and the outer leg 32 are normally inclined toward each other for engagement with their adjacent legs 26 and 30. The tension in the inner leg 30 relative t the second leg 26 as exerted by the lower bent portion 36 enables a score card indicated at 37 to be removably retained in secure position between the legs 26 and 30, as illustrated in FIGS. 1 and 4.

As shown in FIG. 2, the outer leg 32 of the clip member 22 is formed with a reduced neck portion 38 that is connected directly to the upper curved portion 34, an enlarged portion 40 being formed as an integral extension of the neck portion 38. The enlarged portion 40 can be formed in any specific configuration as desired; although, as illustrated, the enlarged portion 40 is formed in a generally circular configuration, wherein the additional surface area as defined thereby enables appropriate indicia, such as advertising or other descriptive material, to be imprinted thereon.

As also illustrated more clearly in FIG. 2, the upper curved portion 34 of the second clip member 22 has a central opening 42 formed therein that is dimensioned to receive a conventional golf pencil 44, the golf pencil as shown in FIG. 4 extending through the opening 42 and being retained in place between the legs 30 and 32. It is seen that as the pencil 44 is inserted through the opening 42 in the upper portion 34, the body of the pencil forces the outer leg 32 outwardly, the outer leg 32 exerting frictional contact on the pencil body to firmly secure the pencil within the opening 42 between the legs 30 and 32. Since the pencil 44 is slidably received between the legs 30 and 32, it is easily withdrawn from the inserted position for use as desired.

Also formed in the upper curved portion 34 of the second clip member 22 on opposite sides of the opening 42 are openings 46 each of which has a diameter somewhat less than that of the opening 42 and being dimensioned to receive the shank of a golf tee 48 therein. It is seen that the golf tees are inserted into the openings 46 up to the tee heads and are thereby securely retained in frictional engagement in the holes 46 for withdrawal therefrom as needed for use.

In use of the device 10, the first clip member 20 is mounted over the upper edge 16 of the body 14 of the golf bag as illustrated, the first leg 24 of the clip member 20 cooperating with the second leg 26 thereof to firmly retain the device 10 in fixed position on the uppermost portion of the golf bag 12. With the device 10 mounted in place, the score card 37 is urged between the second leg 26 of the clip member 20 and inner leg 30 of the second clip member 22, the second and inner legs cooperating in such a manner so that when the score card 37 is inserted therebetween, frictional contact is exerted against the score card surfaces to retain it in firm, fixed position therein. However, because of the resiliency of he legs 26 and 30 relative to each other as determined by the lower curved portion 36, the score card 37 can be easily removed from the position as shown in FIG. 1 for entering scores thereon. With the device 10 as mounted in place, it is also convenient to locate the pencil 44 in the opening 42 of the upper curved portion 34 of the second clip member 22, the pencil 44 urging the outer leg 32 outwardly so as to retain the pencil in firm position between the inner and outer legs of the clip member 22. As described hereinabove, the tees 48 are further mounted in place within the openings 46 for withdrawal for use as desired.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A device for attachment to a golf bag and for holding golf accessory articles, such as a score card, pencil, golf tees and the like, comprising a first clip member having adjacent opposed first and second legs integrally joined at an end thereof by an upper curved portion of predetermined radius, said first leg having a free end that is normally urged toward the adjacent second leg in engaging relation and defining a spring element, said first clip member being insertable over an edge of said golf bag wherein said first leg is urged into firm engaging relation with an interior surface of said golf bag and the adjacent second leg firmly engage an outer surface of said golf bag, wherein said device is securely mounted in place on said golf bag, a second clip member including an inner leg integrally joined to said second leg of said first clip member by a lower bent end of reduced radius relative to the radius of said upper curved portion, wherein said second and inner legs are normally disposed in face-to-face engaging relation but are pivotally movable relative to each other, a score card being removably retained between said second and inner legs when said device is mounted in place on a golf bag, and an outer leg integrally joined to said inner leg by a second upper curved portion having a radius of curvature similar to the radius of said first named upper curved portion, said outer leg normally extending at an angle relative to said inner leg, wherein a lower portion thereof that is opposite to said second named upper curved portion is urged into engagment with an adjacent lower portion of said inner leg, and at least one opening formed in said second named upper curved portion for receiving a pencil therein, wherein a portion of said pencil that extends through said opening engages adjacent surfaces of said inner and outer legs in frictional contact therewith and is thereby retained in removable position in said opening with easy access to the portion thereof that is located above said opening for removing said pencil as required.

2. A device as claimed in claim 1, said clip members being molded in a one-piece construction of a plastic material.

3. A device as claimed in claim 1, at least one other opening formed in said second upper curved portion for receiving a golf tee therein.

4. A device as claimed in claim 1, said outer leg being formed with an enlarged depending portion that provides for the imprinting of identifying or advertising indicia thereon.

5. A device as claimed in claim 1, the free end of said first leg of said first clip member extending downwardly beyond the lowermost point of said lower bent end that joins said second and inner legs, wherein said first leg cooperates with said second leg to firmly retain said device in place on said golf bag.

* * * * *